US008898844B1

(12) United States Patent
Dooley et al.

(10) Patent No.: US 8,898,844 B1
(45) Date of Patent: Dec. 2, 2014

(54) MOPPING ASSEMBLY FOR A MOBILE ROBOT

(75) Inventors: Michael Dooley, Pasadena, CA (US); Nikolai Romanov, Oak Park, CA (US)

(73) Assignee: iRobot Corporation, Bedford, MA (US)

( * ) Notice: Subject to any disclaimer, the term of this patent is extended or adjusted under 35 U.S.C. 154(b) by 274 days.

(21) Appl. No.: 13/495,912

(22) Filed: Jun. 13, 2012

Related U.S. Application Data

(60) Provisional application No. 61/505,914, filed on Jul. 8, 2011.

(51) Int. Cl.
*A47L 11/10* (2006.01)
*A47L 13/22* (2006.01)

(52) U.S. Cl.
CPC *A47L 11/10* (2013.01); *A47L 13/22* (2013.01)
USPC ..... 15/98; 15/319; 15/49.1

(58) Field of Classification Search
USPC ..... 15/319, 340.1, 320, 98, 49.1
See application file for complete search history.

(56) References Cited

U.S. PATENT DOCUMENTS

| | | | | |
|---|---|---|---|---|
| 4,991,250 | A | 2/1991 | Young | |
| 5,377,378 | A * | 1/1995 | Cutler | 15/230 |
| 6,584,990 | B2 | 7/2003 | Shaw | |
| 8,069,520 | B2 | 12/2011 | Mattucci et al. | |
| 8,205,293 | B2 | 6/2012 | Rosenzweig et al. | |
| 8,245,351 | B2 | 8/2012 | Rosenzweig et al. | |
| 8,353,074 | B2 | 1/2013 | Krebs | |
| 8,387,193 | B2 | 3/2013 | Ziegler et al. | |
| 8,407,848 | B2 * | 4/2013 | Pung et al. | 15/228 |
| 8,483,881 | B2 * | 7/2013 | Ermakov et al. | 700/259 |
| 2005/0229340 | A1 | 10/2005 | Sawalski et al. | |
| 2006/0293794 | A1 | 12/2006 | Harwig et al. | |
| 2007/0209139 | A1 * | 9/2007 | Carlucci et al. | 15/322 |
| 2009/0281661 | A1 | 11/2009 | Dooley et al. | |
| 2012/0145191 | A1 | 6/2012 | Williams et al. | |
| 2012/0227763 | A1 | 9/2012 | Hayes et al. | |

* cited by examiner

*Primary Examiner* — Shay Karls
(74) *Attorney, Agent, or Firm* — Knobbe, Martens, Olson & Bear LLP

(57) ABSTRACT

A robot cleaning system for mopping floors is disclosed. The mopping assembly includes a reservoir with a dispenser for outputting fluid to a cleaning cloth. The rate at which fluid is dispensed is regulated with an air inlet in contact with the cleaning cloth. When the cloth is dry, more fluid is dispensed. When the cloth is damp, less fluid is dispensed. The dispenser in the exemplary embodiment also includes a wick configured to conduct the cleaning fluid directly to the cleaning cloth.

24 Claims, 10 Drawing Sheets

MOPPING ASSEMBLY FOR A MOBILE ROBOT

CROSS-REFERENCE TO RELATED APPLICATION

This application claims the benefit of U.S. Provisional Patent Application Ser. No. 61/505,914 filed Jul. 8, 2011, entitled "Mopping assembly for a mobile robot," which is hereby incorporated by reference herein for all purposes.

TECHNICAL FIELD

The invention generally relates to a robotic cleaning system for mopping a floor. In particular, the cleaning system employs a fluid dispenser with a wicking system that effectively regulates the rate at which fluid is dispensed to a cleaning cloth that mops the floor.

BACKGROUND

There are a variety of robots programmed to clean and mop floors. These robots may traverse a room in a random or pseudo-random manner pre-programmed in the robot navigation system. A pump on the robot is used to squirt cleaning agent or other fluid on the floor as the robot traverses the space. The pump is powered using a battery that is carried onboard the robot and recharged when not in use at a docking station, for example. Wires running to the battery provide power to the pump. Depending on the configuration of the robot, the electrical wiring may further include plugs to remove the pump along with a cleaning attachment. As such, use a pump adds to the complexity, weight, and power consumption of the robot without adding to its reliability. There is therefore a need for a mechanism to passively dispense cleaning fluid in a controlled manner without an electronically controlled pump.

SUMMARY

The invention in some embodiments features a mopping assembly for a robotic cleaning system. The mopping assembly includes a reservoir for holding fluid and a fastener for securing a cleaning cloth. The reservoir includes a dispenser for outputting fluid from the reservoir to the cleaning cloth, and an air inlet in contact with the cleaning cloth. The location of the inlet hole relative to the dispenser and the cleaning cloth effectively regulates the rate at which the liquid is dispensed from the fluid reservoir. The dispenser in the exemplary embodiment includes a wick configured to directly contact the cleaning cloth. The wick protrudes from the reservoir on the same side as the air inlet, preferably the bottom side of the reservoir, to aid in regulating the flow of fluid through the wick. In addition, the wick and the air inlet are at the same height when the robotic cleaning system is in an upright storage orientation to prevent leakage of the cleaning fluid when the robotic cleaner is not in use.

BRIEF DESCRIPTION OF THE DRAWINGS

The present invention is illustrated by way of example and not limitation in the figures of the accompanying drawings, and in which.

DESCRIPTION OF THE EXEMPLARY EMBODIMENT

Figure 1:
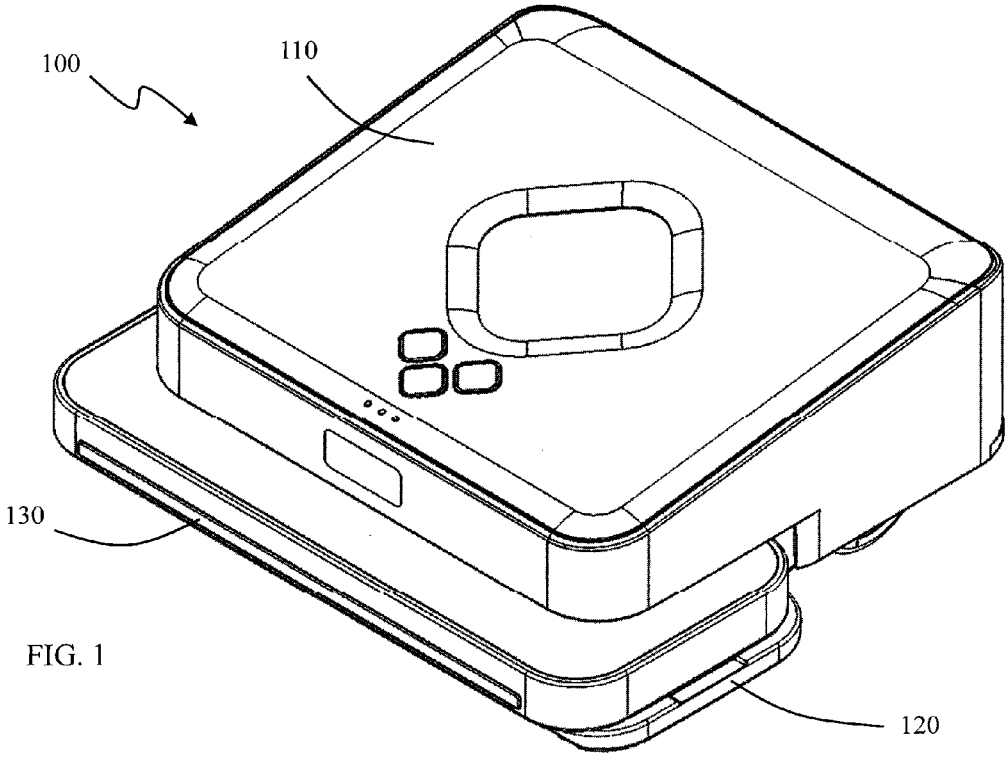
FIG. 1 is an isometric top view of a robotic cleaner, in accordance with an exemplary embodiment of the invention.

The present invention features a mopping assembly for a mobile robot configured to clean floors. The mopping assembly includes a detachable cloth and a fluid reservoir to moisten the cloth with cleaning fluid. The mobile robot is configured to traverse a room using a trajectory designed to effectively scrub the floor with the wet cloth. An exemplary mobile robot is taught in U.S. patent application Ser. No. 12/930,260 filed Dec. 30, 2010, and optimal trajectories are taught in U.S. patent application Ser. No. 12/928,965 filed Dec. 23, 2010, both of which are hereby incorporated by reference herein. An exemplary mobile robot 100 with mopping assembly 120 is shown in FIGS. 1-4. The robot includes a housing 110 that encloses the navigation and control system (not shown), drive motor (not shown), and a portion of the drive wheels 280. The mopping assembly 120 is positioned at the front of the robot behind a bump sensor 130. Drop sensors 270 operate through openings in the mopping assembly. Fluid is dispensed from the dispenser 240 and air admitted into the reservoir through inlet 250 on the bottom surface 260 of the mopping assembly.

Figure 10:
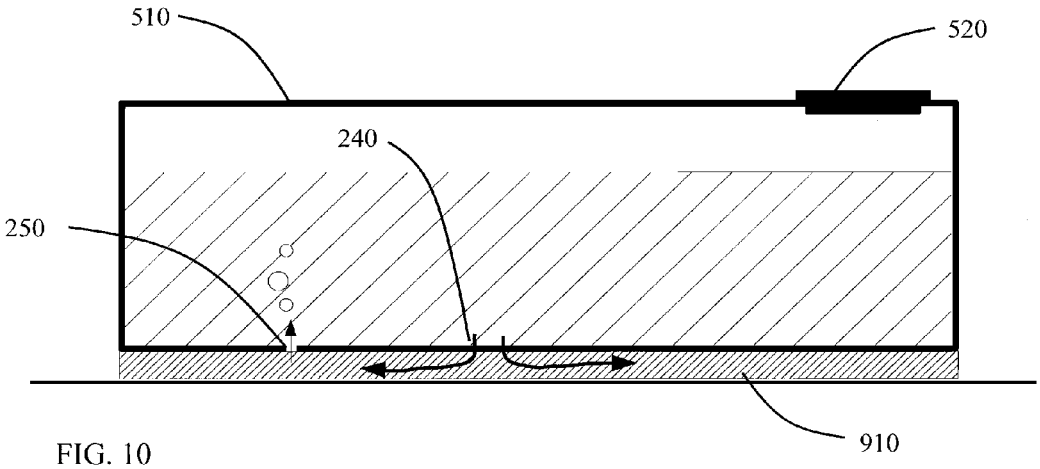
FIG. 10 is a diagrammatic cross section of the mopping assembly, in accordance with an exemplary embodiment of the invention.
Figure 2:
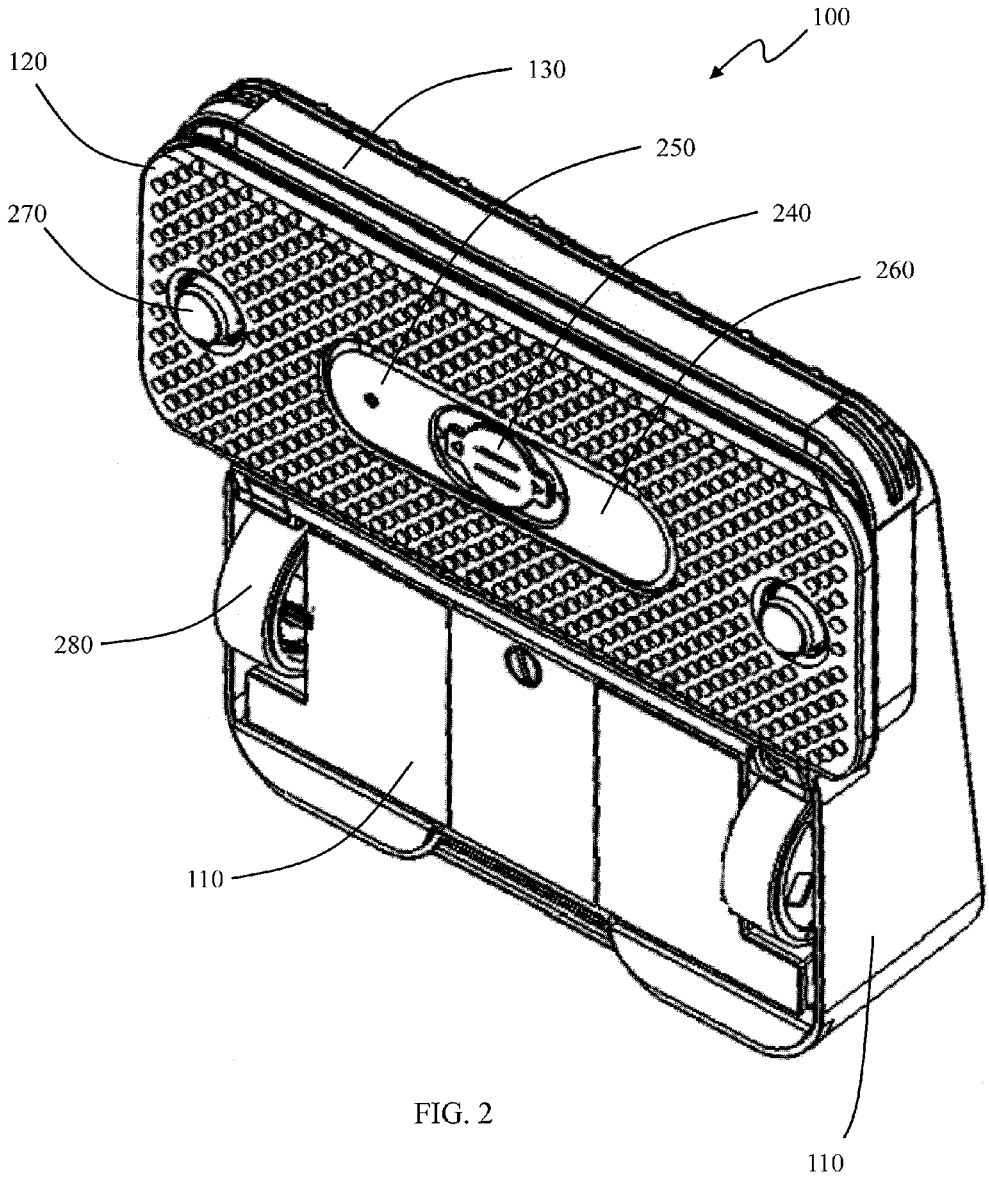
FIG. 2 is an isometric bottom view of the robot cleaner, in accordance with an exemplary embodiment of the invention.

The preferred embodiment of the mopping assembly 100 is shown alone in FIGS. 5-9, and a schematic illustration of a mopping assembly shown in cross section in FIG. 10. In each case, the exemplary embodiment of the mopping assembly 120 includes a cleaning fluid reservoir 510, a fluid dispenser 240 including a wick 920 to regulate fluid flow to the cleaning cloth 910, a fastener 530 for attaching the cleaning cloth, and a mechanism for attaching the mopping assembly to the robot. In some embodiments, the reservoir consists of a single, continuous chamber. In this particular embodiment, however, the reservoir 510 includes a first chamber 512 and a second chamber 514 that are internally connected by means of a narrow central channel 513 joining the two chambers. A refill cap 520 is located at the top of the first chamber, while the fluid dispenser is located at the bottom of the central channel. For reasons explained below, the refill cap must provide an air-tight fit to the reservoir.

Figure 3:
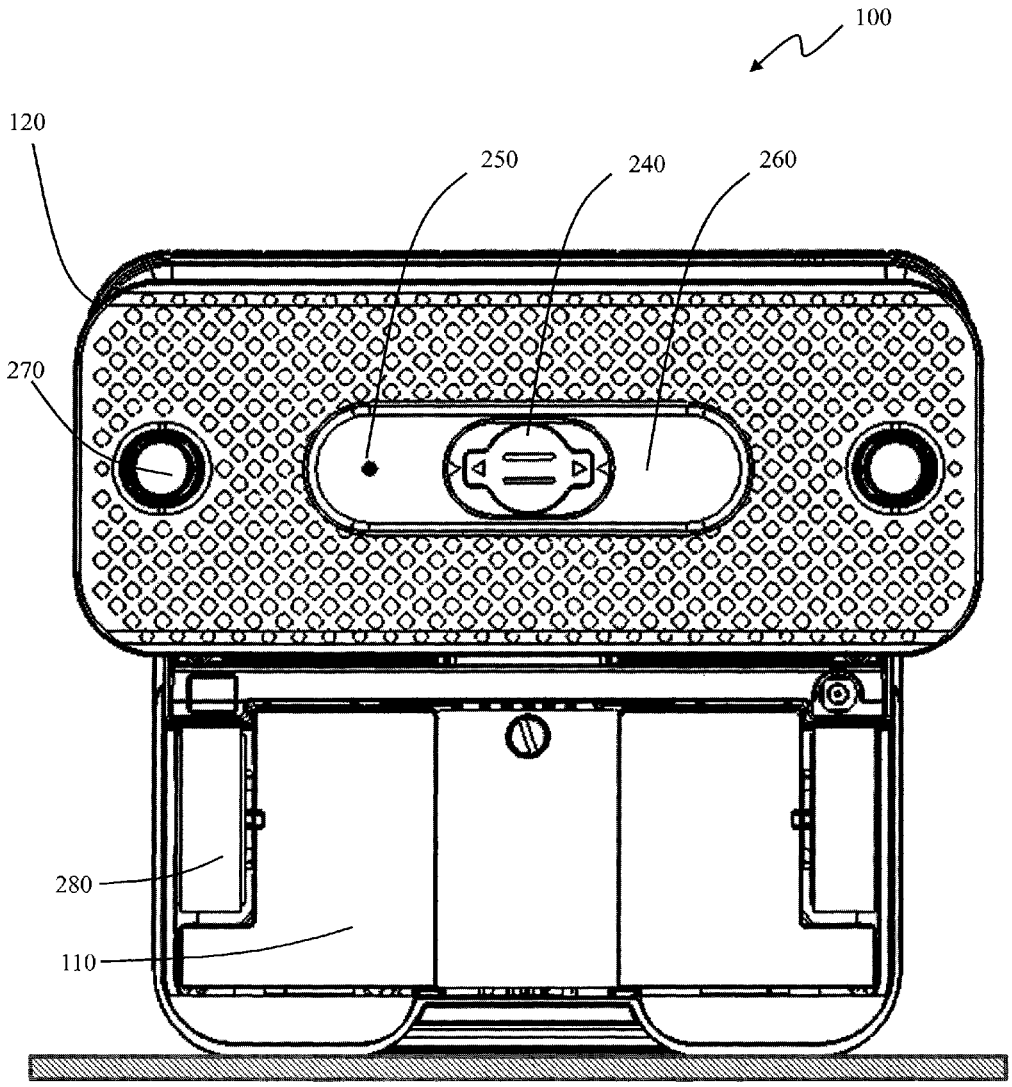
FIG. 3 is a bottom view of the robotic cleaner being stored in a vertical or upright orientation, in accordance with an exemplary embodiment of the invention.
Figure 4:
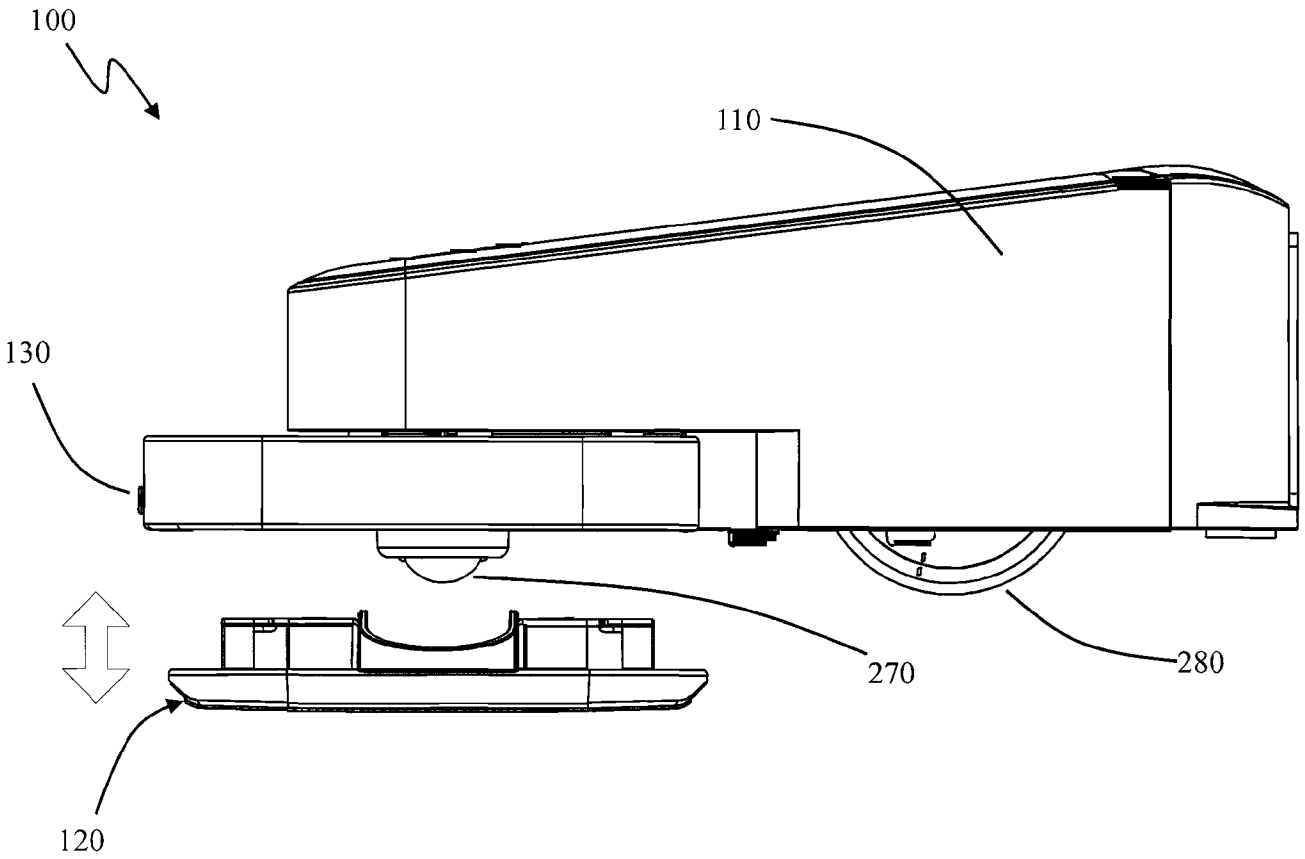
FIG. 4 is an exploded view of the robot body and mopping assembly, in accordance with an exemplary embodiment of the invention.
Figure 5:
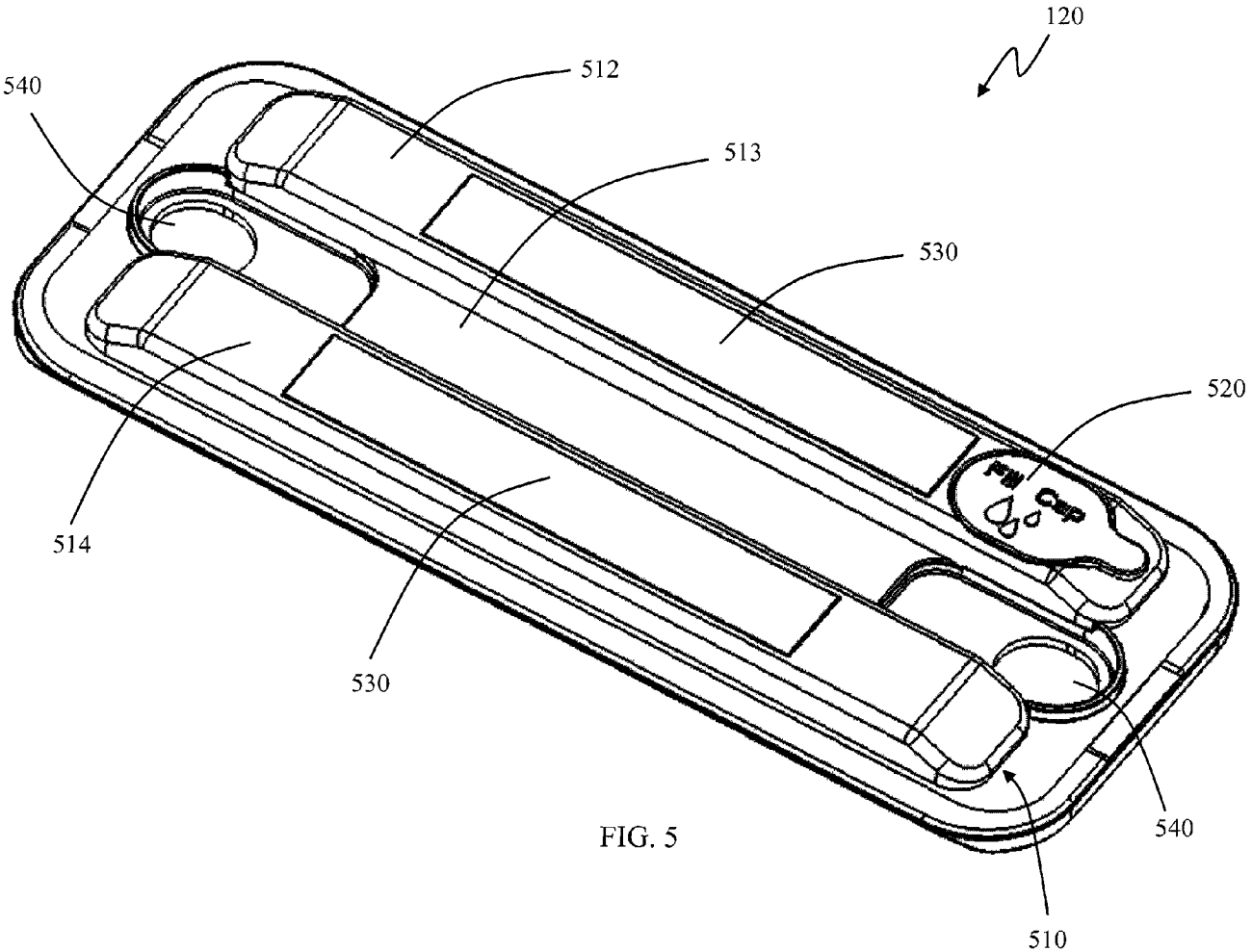
FIG. 5 is an isometric top view of the mopping assembly, in accordance with an exemplary embodiment of the invention.
Figure 6:
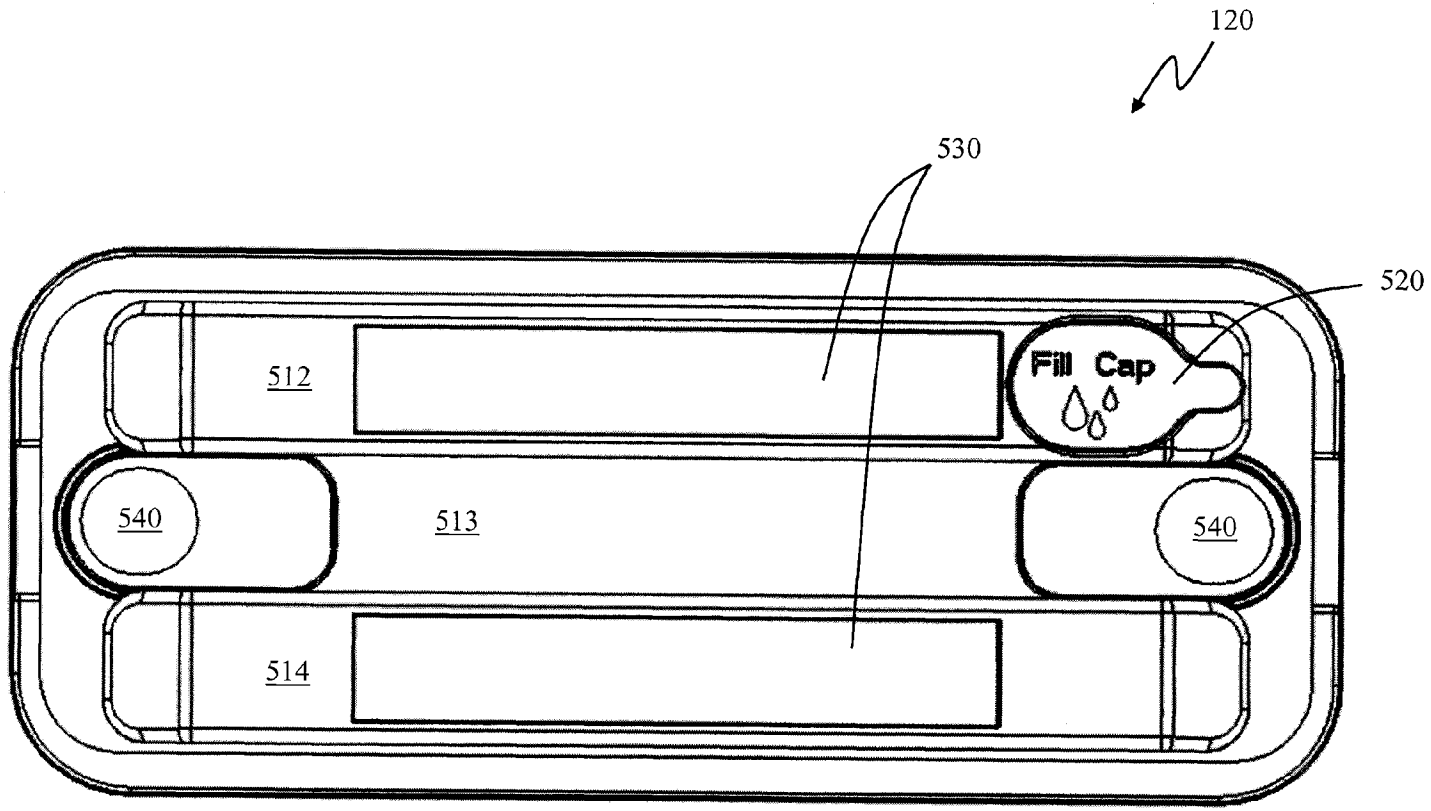
FIG. 6 is a top view of the mopping assembly, in accordance with an exemplary embodiment of the invention.

A vent hole or inlet 250 may also be incorporated into the chamber to admit air into the chamber as fluid is dispensed. Air must be admitted into the reservoir to prevent a vacuum which would effectively stop the flow of fluid out of the reservoir. In the exemplary embodiment, the air inlet 250 is placed on the bottom surface 260 of the central channel 513 on the same side of the reservoir and the wick and in proximity to the wick where it is in contact with the cleaning cloth. The location of the inlet serves, in part, as a self-regulating mechanism that helps control the rate of fluid dispensed. When the cleaning cloth is dry, air readily passes through the cleaning cloth 910 and into the reservoir which allows fluid to flow out of the reservoir at a relatively high rate. As the cleaning cloth 910 becomes damp in the region immediately in contact with the air inlet, the flow of air through the cloth is inhibited which, in turn, inhibits the flow of fluid dispensed through the wick. The location of the inlet also serves to minimize the leakage of fluid when the robotic cleaner is being stored or otherwise not operated. In particular, the inlet 250 is located in proximity to the wick (within 2 inches), and the inlet and wick are at the same elevation when the robotic cleaner is stored in the vertical orientation as shown in FIG. 3. Having the inlet and wick at the same elevation ensures that (a) the fluid level is above both the inlet and wick, or (b) the fluid level is below both the inlet and wick, which will avoid inadvertent leakage through either opening if the fluid level were above one opening but below the other.

Figure 11:
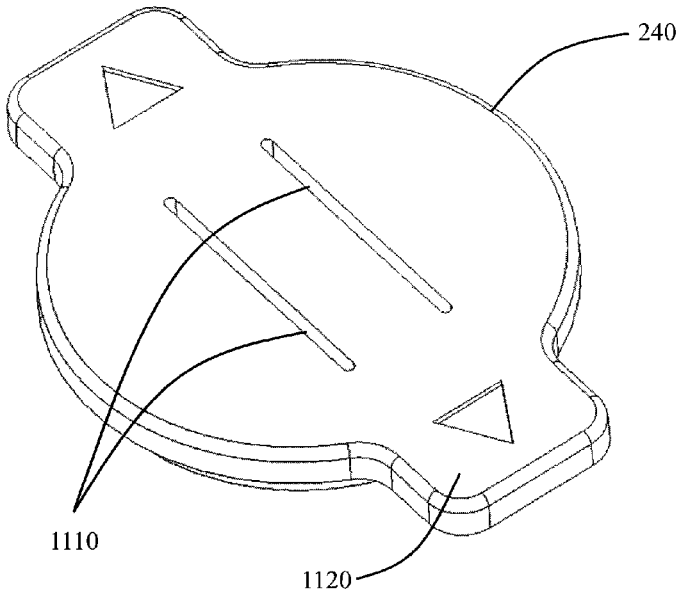
FIG. 11 is an isometric top view of a wick cap, in accordance with an exemplary embodiment of the invention.
Figure 12:
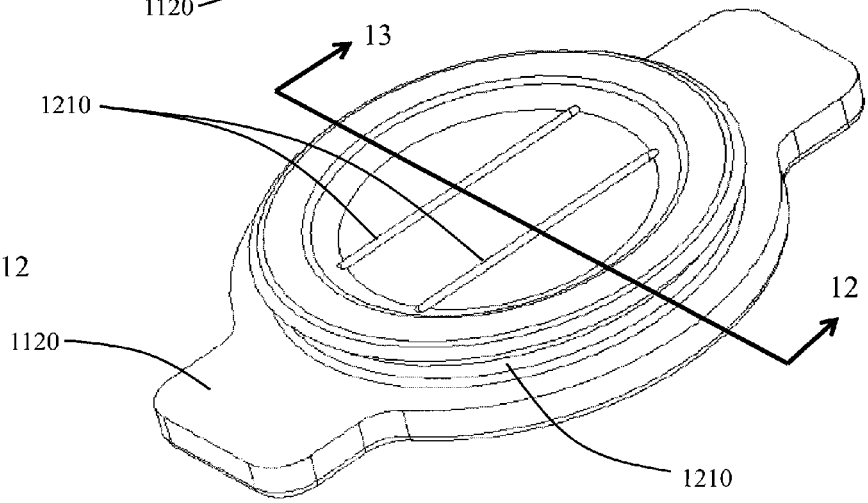
FIG. 12 is an isometric bottom view of the wick cap, in accordance with an exemplary embodiment of the invention.
Figure 13:
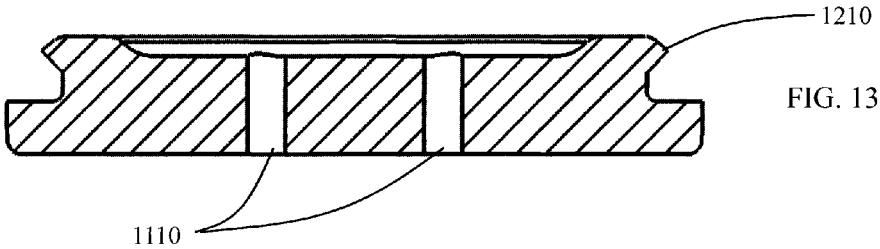
FIG. 13 is a sectional view of the wick cap, in accordance with an exemplary embodiment of the invention.

The wick 920 in the preferred embodiment is a microfiber cloth or cord having a tubular or cylindrical shape to enhance the flow of fluid through the wick. The wick is mounted in a silicon wick cap or plug 240 at the bottom of the reservoir, which allows the wick to contact both the fluid in the reservoir as well as the top side of the cleaning cloth. As shown in the preferred embodiment in FIGS. 11-13, the wick cap includes two parallel slits 1110 through which the wick is folded into a U-shape. The bottom portion of the wick protrudes beyond the bottom face of the reservoir, which causes the cleaning cloth to be pressed against the wick. This pressure enhances contact and fluid flow between the wick and cloth. The cleaning fluid passes through the wick to the center of the cleaning cloth. From there, fluid then wicks laterally through the cloth across the bottom of the mopping assembly, as indicated by horizontal arrows in FIG. 10. In the preferred embodiment, the cloth 910 is made of a woven microfiber material with an upper portion and lower portion, where the upper portion includes long strands for wicking fluid and the lower portion includes looping strands for effective scrubbing. In the preferred embodiment, the flow rate through the wick is high enough to keep the cleaning cloth wet for approximately 50 to 90 minutes.

Figure 7:
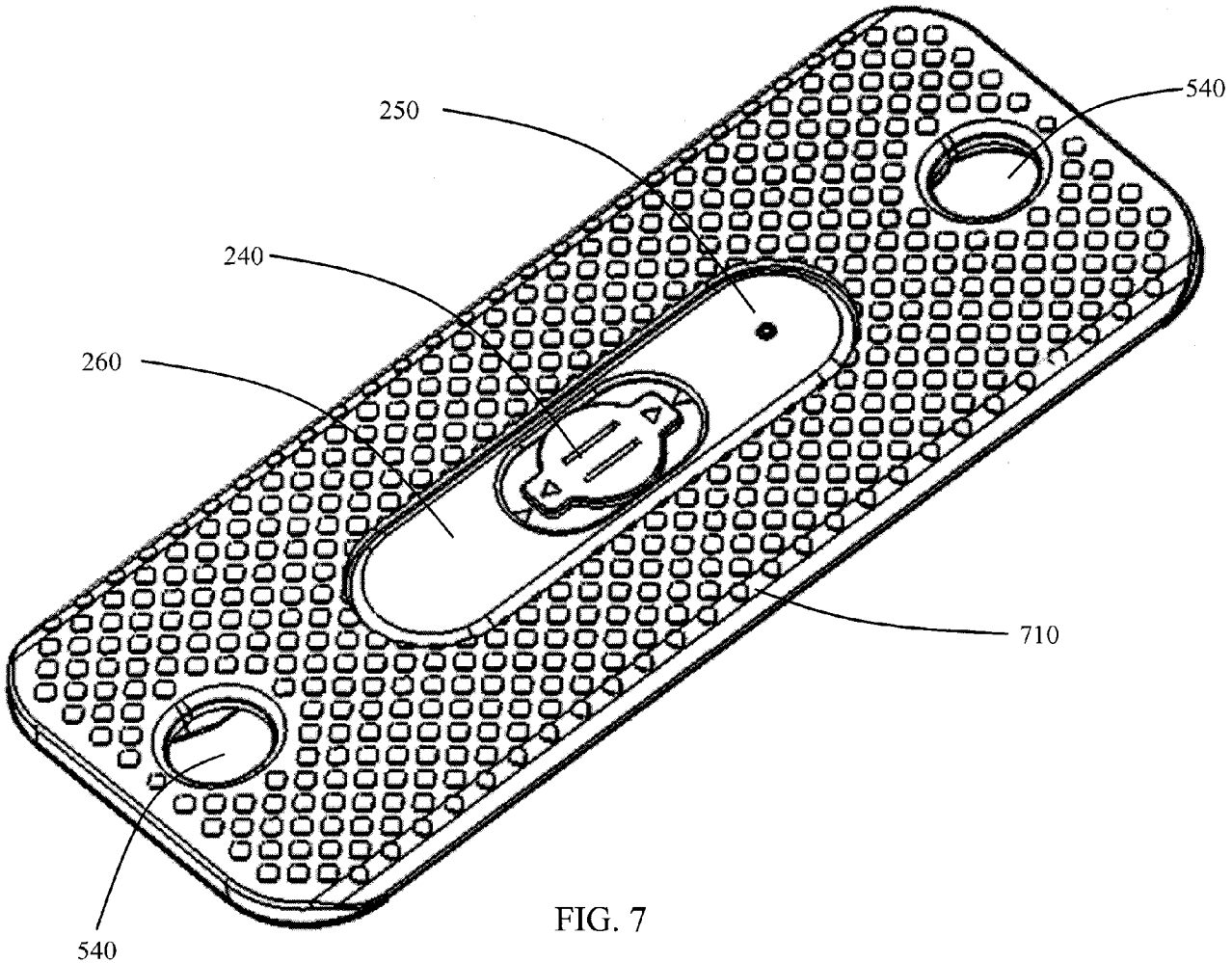
FIG. 7 is an isometric bottom view of the mopping assembly, in accordance with an exemplary embodiment of the invention.
Figure 8:
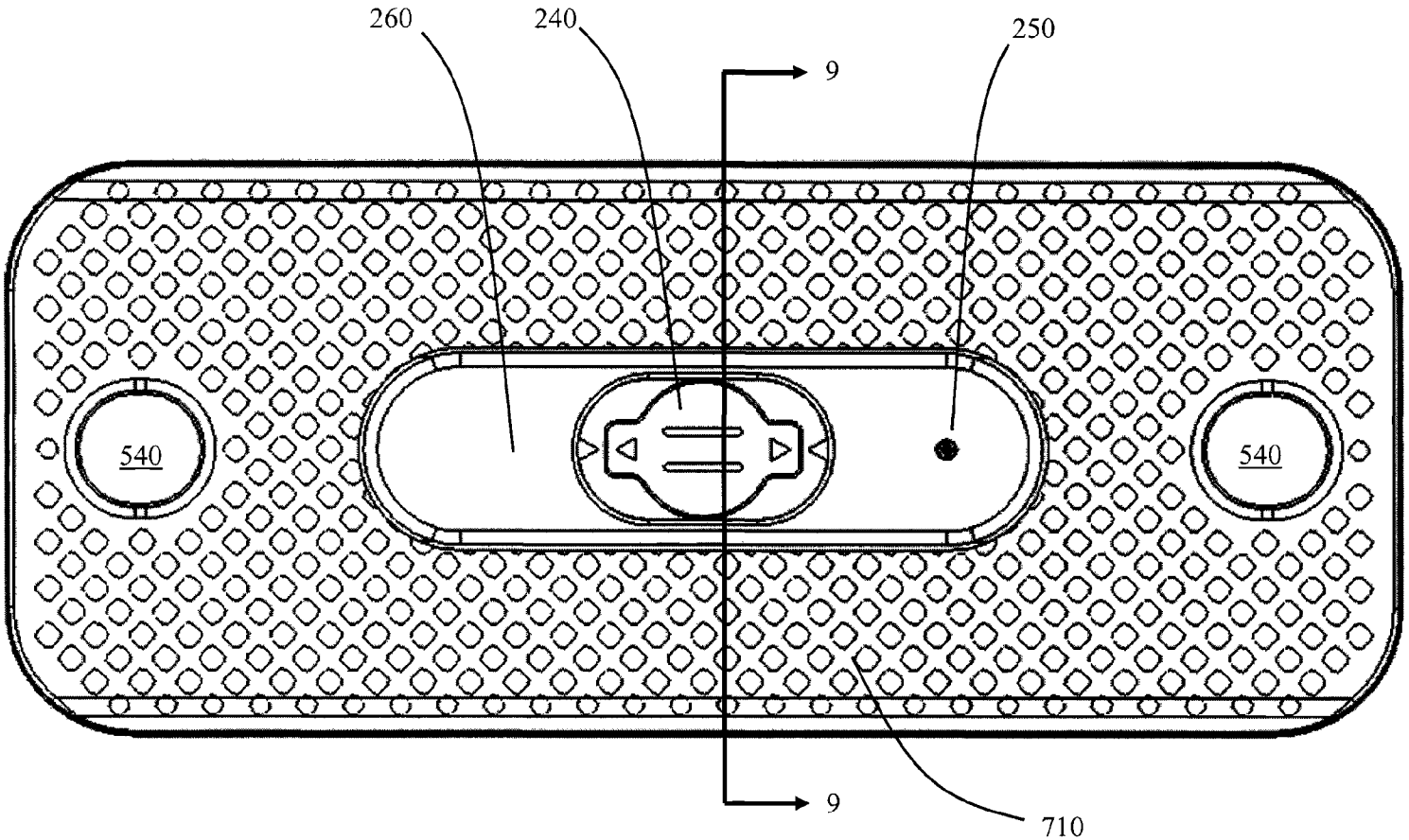
FIG. 8 is a bottom view of the mopping assembly, in accordance with an exemplary embodiment of the invention.
Figure 9:
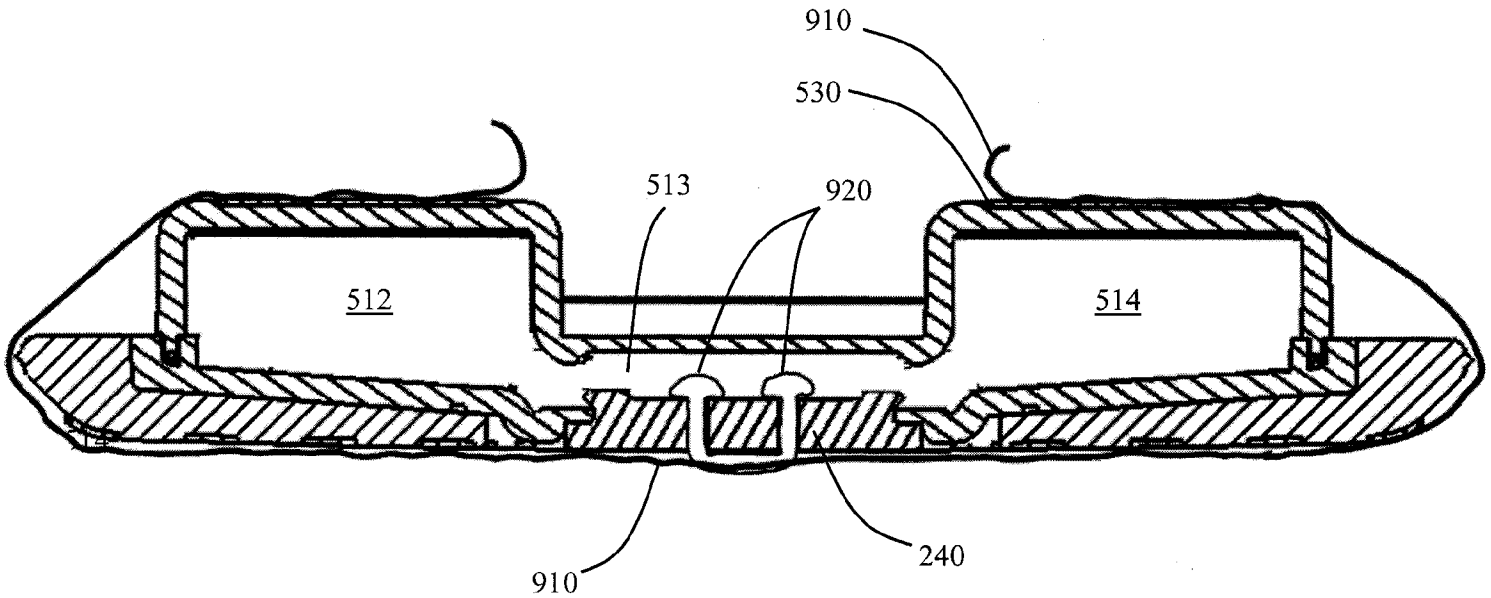
FIG. 9 is a cross sectional view of the mopping assembly, in accordance with an exemplary embodiment of the invention.

The cleaning cloth 910 is large enough to cover the bottom of the mopping assembly and wrap around at least a portion of the reservoir. In the preferred embodiment, the cloth attaches to Velcro hook and loop fasteners on the top of the reservoir. In other embodiments, the cloth is attached using pins, clips, clasps, straps, or combination thereof. When soiled, the cloth may be conveniently removed for washing or replaced with a fresh cloth. The bottom surface of the moping assembly 710 may include bumps or other protrusions as shown in FIG. 7 to enhance the scrubbing ability of the cleaning cloth.

Recommended cleaning fluids include water and Ph-neutral detergents such as Bona.

The mopping assembly 120 is detachably attached to the robot housing. In an exemplary embodiment, magnets (not shown) are used to retain the mopping assembly. Magnets affixed to the robot housing and ferrous metal on the mopping assembly, together, produce a biasing force that holds the mopping assembly in contact with the housing. In the alternative, magnets may be embedded in the housing and the top portion of the mopping assembly to produce an attractive force that holds the mopping attachment to the robot housing.

The mopping assembly in some embodiments includes one or more apertures 540 configured to receive drop sensors 270. The drop sensors include probes that press downward against the top of the cleaning cloth. When the mopping assembly is over a flat surface, the bottom of the probes are approximately flush with the bottom surface of the mopping assembly. When the mopping assembly losses contact with the floor, however, one or more of the probes drop or push through outward through the aperture. Displacement of the drop sensors 270 indicates a staircase, step, or rug, for example, which triggers the robotic cleaner to back up and change course.

In some embodiments, a plurality of wicks may be used to dispense cleaning fluid at multiple points of the cleaning cloth. The silicon cap 240 employed to retain the one or more wicks may be placed at different locations on the bottom, side, or top of the reservoir provided the wicks make contact with the cleaning cloth. Multiple interchangeable silicon caps may be selected and inserted in the reservoir by the user to effectively change the rate at which cleaning fluid is dispensed from the reservoir, each cap having slits with a different size, width, length, and/or shape. Similarly, different sizes of air inlets 250 may be employed to alter the fluid rate as well. In other embodiments, an electronically controlled valve (not shown) for regulating the size of the air inlet may be used to dynamically control the fluid rate during the same cleaning session or between different cleaning sessions. The flow rate may be dynamically changed during a session to, for example, begin with a higher flow rate if the cleaning cloth is dry, and then reduce the rate based on elapse time or in response to a sensor indicating that the cleaning cloth is damp. In still other embodiments, the air inlet has a truncated conical shape, the small hole facing the interior of the reservoir and the large hole facing outward, to inhibit dust and dirt from plugging the inlet over time.

In the preferred embodiment, the reservoir and wick are incorporated in the mopping assembly, which is detachable from the main robot housing. In other alternative embodiments, the reservoir and/or wick may be integrated in the housing and therefore not removable. Similarly, the cleaning cloth may be detachably attached to the mopping assembly or directly to the robot housing.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

We claim:

1. A mopping assembly for a robotic cleaning system, the mopping assembly comprising:

a fastener for securing a cleaning cloth; and a reservoir for holding fluid, the reservoir comprising:

a dispenser for outputting fluid from the reservoir to the cleaning cloth; and an air inlet;

wherein the dispenser and the air inlet are located on a same side of the reservoir and wherein the dispenser comprises at least one slit and a wick incorporated into a removable cap for refilling the reservoir, the wick configured to contact the cleaning cloth and the at least one slit is configured to secure the wick.

2. The mopping assembly of claim 1, wherein the dispenser comprises a wick configured to contact the cleaning cloth.

3. The mopping assembly of claim 2, wherein the dispenser further comprises at least one slit for securing the wick.

4. The mopping assembly of claim 3, wherein the dispenser comprises at least two parallel slits through which the wick is folded.

5. The mopping assembly of claim 2, wherein the wick and the air inlet are at the same height when the robotic cleaning system is in an upright storage orientation.

6. The mopping assembly of claim 1, wherein the air inlet comprises a hole less than one millimeter in diameter.

7. The mopping assembly of claim 1, wherein the fastener comprise hook and loop fasteners.

8. The mopping assembly of claim 1, further comprising one or more drop sensors.

9. The mopping assembly of claim 8, wherein the one or more drop sensors are configured to sense a drop through the cleaning cloth.

10. The mopping assembly of claim 1, further comprising the cleaning cloth, wherein the cleaning cloth comprises a first portion with long strands for wicking fluid and a lower portion with looping strands for effective scrubbing.

11. The mopping assembly of claim 1, wherein the dispenser and the air inlet are located on a bottom side of the reservoir.

12. The mopping assembly of claim 11, wherein the air inlet is in contact with the cleaning cloth.

13. The mopping assembly of claim 12, wherein wetness of the cleaning cloth regulates a rate at which the fluid is dispensed from the reservoir.

14. A mopping assembly for a robotic cleaning system, the mopping assembly comprising:

a reservoir for holding fluid;

a dispenser for outputting fluid from the reservoir to a cleaning cloth, wherein the dispenser comprises at least one slit and a wick incorporated into a removable cap for refilling the reservoir, wherein the wick is configured to contact the cleaning cloth and the at least one slit is configured to secure the wick; and an air inlet in proximity to the cleaning cloth;

wherein fluid is dispensed in proportion to air admitted into the reservoir.

15. The mopping assembly of claim 14, wherein the dispenser and the air inlet are located on a bottom side of the reservoir.

16. The mopping assembly of claim 14, wherein the dispenser comprises a at least one wick protruding from a bottom side of the reservoir.

17. A mopping assembly for a robotic cleaning system, the mopping assembly comprising:

a fastener for securing a cleaning cloth; and a reservoir for holding fluid, the reservoir comprising:

a dispenser for outputting fluid from the reservoir to the cleaning cloth; and an air inlet;

wherein the dispenser and the air inlet are located on a same side of the reservoir and the dispenser comprises:

a wick configured to contact the cleaning cloth;

at least two parallel slits through which the wick is folded, wherein at least one of the two parallel slits is configured to secure the wick.

18. The mopping assembly of claim 17, further comprising a removable cap, the removable cap comprising the at least two parallel slits and the wick.

19. The mopping assembly of claim 17, further comprising a drop sensor configured to sense a drop through the cleaning cloth.

20. The mopping assembly of claim 17, wherein the dispenser and the air inlet are located on a bottom side of the reservoir.

21. The mopping assembly of claim 17, further comprising a cleaning cloth, wherein the cleaning cloth comprises a first portion having a first type of strands configured to wick fluid and a second portion with a second type of strands configured to scrub, where the first type of strands are of a different physical configuration than the second type of strands.

22. A mopping assembly for a robotic cleaning system, the mopping assembly comprising:

a reservoir for holding fluid;

a dispenser for outputting fluid from the reservoir to a cleaning cloth, wherein the dispenser comprises:

a wick configured to contact the cleaning cloth;

at least two parallel slits through which the wick is folded, wherein at least one of the two parallel slits is configured to secure the wick; and an air inlet in proximity to the cleaning cloth;

wherein fluid is dispensed in proportion to air admitted into the reservoir.

23. The mopping assembly of claim 22, wherein the dispenser and the air inlet are located on a bottom side of the reservoir.

24. The mopping assembly of claim 22, wherein the dispenser comprises at least one wick protruding from a bottom side of the reservoir.

* * * * *

UNITED STATES PATENT AND TRADEMARK OFFICE

CERTIFICATE OF CORRECTION

PATENT NO. : 8,898,844 B1
APPLICATION NO. : 13/495912
DATED : December 2, 2014
INVENTOR(S) : Michael Dooley It is certified that error appears in the above-identified patent and that said Letters Patent is hereby corrected as shown below:

In the Claims

In column 6 at line 2, In Claim 16, change “a at” to --at--.

Signed and Sealed this
Twenty-third Day of June, 2015

Michelle K. Lee

Michelle K. Lee
*Director of the United States Patent and Trademark Office*